US009828713B2

(12) United States Patent
Dayan

(10) Patent No.: US 9,828,713 B2
(45) Date of Patent: Nov. 28, 2017

(54) SYSTEM AND METHOD FOR WETSUIT WASHING AND COMPONENTS THEREFOR

(71) Applicant: Maor Dayan, Ramat Gan (IL)

(72) Inventor: Maor Dayan, Ramat Gan (IL)

( * ) Notice: Subject to any disclaimer, the term of this patent is extended or adjusted under 35 U.S.C. 154(b) by 246 days.

(21) Appl. No.: 14/617,970

(22) Filed: Feb. 10, 2015

(65) Prior Publication Data

US 2016/0230325 A1 Aug. 11, 2016

(51) Int. Cl.

| | |
|---|---|
| ***D06F 39/10*** | (2006.01) |
| ***D06B 1/08*** | (2006.01) |
| ***D06B 23/04*** | (2006.01) |
| ***D06F 1/12*** | (2006.01) |
| ***D06B 1/02*** | (2006.01) |
| ***D06B 23/20*** | (2006.01) |
| ***D06B 3/24*** | (2006.01) |
| ***D06B 3/28*** | (2006.01) |
| ***D06F 57/00*** | (2006.01) |
| *D06F 7/00* | (2006.01) |
| *D06F 17/04* | (2006.01) |
| *B63C 11/04* | (2006.01) |

(52) U.S. Cl.

CPC ..... *D06B 23/04* (2013.01); *D06B 1/02* (2013.01); *D06B 1/08* (2013.01); *D06B 3/24* (2013.01); *D06B 3/28* (2013.01); *D06B 23/20* (2013.01); *D06F 57/00* (2013.01); *B63C 2011/046* (2013.01); *D06F 7/00* (2013.01); *D06F 17/04* (2013.01)

(58) Field of Classification Search

CPC ..... D06B 23/04; D06B 23/20; D06B 1/02; D06B 1/08; D06B 3/24; D06B 3/28; D06B 1/12; D06B 7/00; D06B 39/10

USPC ..... 8/137

See application file for complete search history.

(56) References Cited

U.S. PATENT DOCUMENTS

| | | | | |
|---|---|---|---|---|
| 3,702,069 | A * | 11/1972 | Sharpe | D06F 37/145 68/12.18 |
| 4,989,624 | A | 2/1991 | Darling | |
| 4,997,000 | A | 3/1991 | Feast | |
| 5,037,487 | A | 8/1991 | Santos | |
| 2002/0112748 | A1* | 8/2002 | Niland | B08B 3/02 134/58 R |
| 2005/0121072 | A1* | 6/2005 | Stengel | H02J 7/355 136/244 |
| 2005/0223502 | A1* | 10/2005 | Kleker | D06F 17/04 8/158 |
| 2005/0274751 | A1 | 12/2005 | Plumley | |
| 2012/0291823 | A1 | 11/2012 | Trent | |

* cited by examiner

*Primary Examiner* — David Cormier
*Assistant Examiner* — Tinsae Ayalew
(74) *Attorney, Agent, or Firm* — Mark M. Friedman

(57) ABSTRACT

A wetsuit washing system includes at least one hanger assembly. A piping arrangement is in communication with the at least one hanger assembly. The piping arrangement distributes a liquid to the at least one hanger assembly. A pump pumps the liquid from a reservoir through the piping arrangement to the at least one hanger assembly. The at least one hanger assembly includes a hollow first irrigation member to permit the flow of liquid there through. The first irrigation member includes first and second support elements. The first support element is substantially arcuate in a first dimension. The second support element is substantially elliptical in a second dimension.

17 Claims, 8 Drawing Sheets

SYSTEM AND METHOD FOR WETSUIT WASHING AND COMPONENTS THEREFOR

TECHNICAL FIELD

The present invention relates to wetsuit cleaning.

BACKGROUND OF THE INVENTION

Wetsuits are commonly used to provide thermal protection against cold water for a variety of activities, including, but not limited to, surfing, water skiing, scuba diving, windsurfing and the like. Wetsuits are typically made from stretchable porous fabrics such as neoprene and the like. A properly fitted wetsuit allows the user to maintain body warmth in cold water conditions by providing layered insulation between the user and the water. Wetsuits are typically exposed to a wide range of foreign objects, including, but not limited to, salt water, urine, sand, rocks and the like. It is therefore necessary to clean wetsuits with fresh water between uses to remove these foreign objects. The lack of cleaning of wetsuits between uses can lead to accelerated deterioration and corrosion of the wetsuit, thus degrading thermal protection. Furthermore, organic materials, such as bacteria and fungi and the like, can accumulate in the wetsuit if not properly cleaned. These organic materials contribute both to the corrosive effects of the wetsuit and present a health hazard to the wetsuit user. Cleaning a wetsuit with fresh water after each use increases the lifespan of the wetsuit, typically by an average of 40%-60%. Wetsuits may be cleaned using a common garden hose, shower or the like. These methods are typically not sufficiently thorough, as the porous neoprene material absorbs foreign objects much like a sponge. Alternative methods have been presented in which a wetsuit is mounted to a hanger like device connected to a garden hose. However, these methods are wasteful in the amounts of fresh water used. Furthermore, the hanger like devices may stretch and damage the wetsuit, leading to poor fitting wetsuits and reduced thermal protection.

SUMMARY OF THE INVENTION

The present invention is a system and method for providing a wetsuit washing functionality.

According to an embodiment of the teachings of the present invention there is provided, a wetsuit washing system comprising: (a) at least one hanger assembly; (b) a piping arrangement in communication with the at least one hanger assembly for distributing a liquid to the at least one hanger assembly; and (c) a pump for pumping liquid from a reservoir through the piping arrangement to the at least one hanger assembly.

Optionally, the wetsuit ashing system comprises: (a) a reservoir in communication with the piping arrangement configured to collect a run-off of liquid from the wetsuit, and wherein the pump is in communication with the reservoir.

Optionally, the wetsuit washing system comprises: (a) a controller associated with the pump configured to actuate the pump to pump the liquid; and (b) a timing device associated with the controller, the timing device including a user interface, the controller responsive to an input via the user interface to selectively: (i) actuate the pump to allow the flow of liquid to the piping arrangement; and (ii) prevent the flow of liquid to the piping arrangement.

Optionally, the wetsuit washing system comprises: (a) a power supply deployed to provide power to the pump, wherein the power supply includes at least one solar panel.

Optionally, the wetsuit washing system comprises: (a) a filter in communication with the pump configured to filter the run-off liquid collected in the reservoir.

Optionally, the wetsuit washing system comprises: (a) an intake port in communication with the piping arrangement, the intake port configured for communicating with a hose for supplying the liquid.

Optionally, the wetsuit washing system comprises: (a) a detergent mixing unit in communication with the intake port for supplying a detergent.

Optionally, the at least one hanger assembly comprises: (i) a first irrigation member configured to supply the liquid to the interior of the wetsuit, the first irrigation member including first and second support elements, the first support element substantially arcuate in a first dimension, and the second support element substantially elliptical in a second dimension, the first and second support elements sufficient to support and retain the wetsuit in an upright and hanging position and to maintain the integrity of the shape of the wetsuit.

Optionally, the second support element includes a plurality of apertures for allowing the liquid to escape into the interior of the wetsuit.

Optionally, the at least one hanger assembly comprises: (i) a second irrigation member in communication with the first irrigation member configured to supply the liquid to the exterior of the wetsuit.

Optionally, the wetsuit washing system comprises: (a) a valve assembly in communication with the at least one hanger assembly for selectively controlling the flow of liquid to the at least one hanger assembly.

Optionally, the wetsuit washing system comprises: (a) a support structure for supporting the at least one hanger assembly; and (b) a cover in communication with the support structure.

There is also provided according to an embodiment of the teachings of the present invention, a wetsuit washing system comprising: (a) at least one hanger assembly, the at least one hanger assembly including a hollow first irrigation member to permit the flow of liquid there through, the first irrigation member including first and second support elements, the first support element substantially arcuate in a first dimension, and the second support element substantially elliptical in a second dimension, the first and second support elements sufficient to support and retain the wetsuit in an upright and hanging position and to maintain the integrity of the shape of the wetsuit.

Optionally, the second support element includes a plurality of apertures for allowing a liquid to escape into the interior of the wetsuit.

Optionally, the at least one hanger assembly includes a second irrigation member in communication with the first irrigation member configured to supply a liquid to the exterior of the wetsuit.

Optionally, the second irrigation member comprises: a sprinkler for allowing the liquid to spray onto the exterior of the wetsuit.

Optionally, the first irrigation member is configured to pressurize the liquid, and the second irrigation member is configured to receive the liquid from the source subsequent to pressurization of the liquid by the first irrigation member.

Optionally, the wetsuit washing system comprises: (a) a valve assembly in communication with the at least one hanger assembly for selectively oiling the flow of liquid to the at least one hanger assembly.

Optionally, the wetsuit washing system comprises: (a) a piping arrangement in communication with the at least one hanger assembly for distributing a liquid to the at least one hanger assembly.

Optionally, the wetsuit washing system comprises: (a) an intake port in communication with the piping arrangement, the intake port configured for communicating with a hose for supplying the liquid.

There is also provided according to an embodiment of the teachings of the present invention, a method for washing a wetsuit comprising: (a) obtaining a hanger assembly, the hanger assembly including a hollow irrigation member to permit the flow of liquid there through for supplying to the wetsuit; (b) mounting the wetsuit onto the hanger assembly; (c) supplying a first quantity of liquid to the hanger assembly from a liquid source; (d) obtaining a reservoir; (e) collecting a run-off from the first quantity of liquid in the reservoir; and (f) pumping the collected liquid to the hanger assembly, the pumped liquid forming at least part of a second quantity of liquid supplied to the hanger assembly.

Optionally, the method for washing a wetsuit comprises; (a) filtering the collected liquid.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
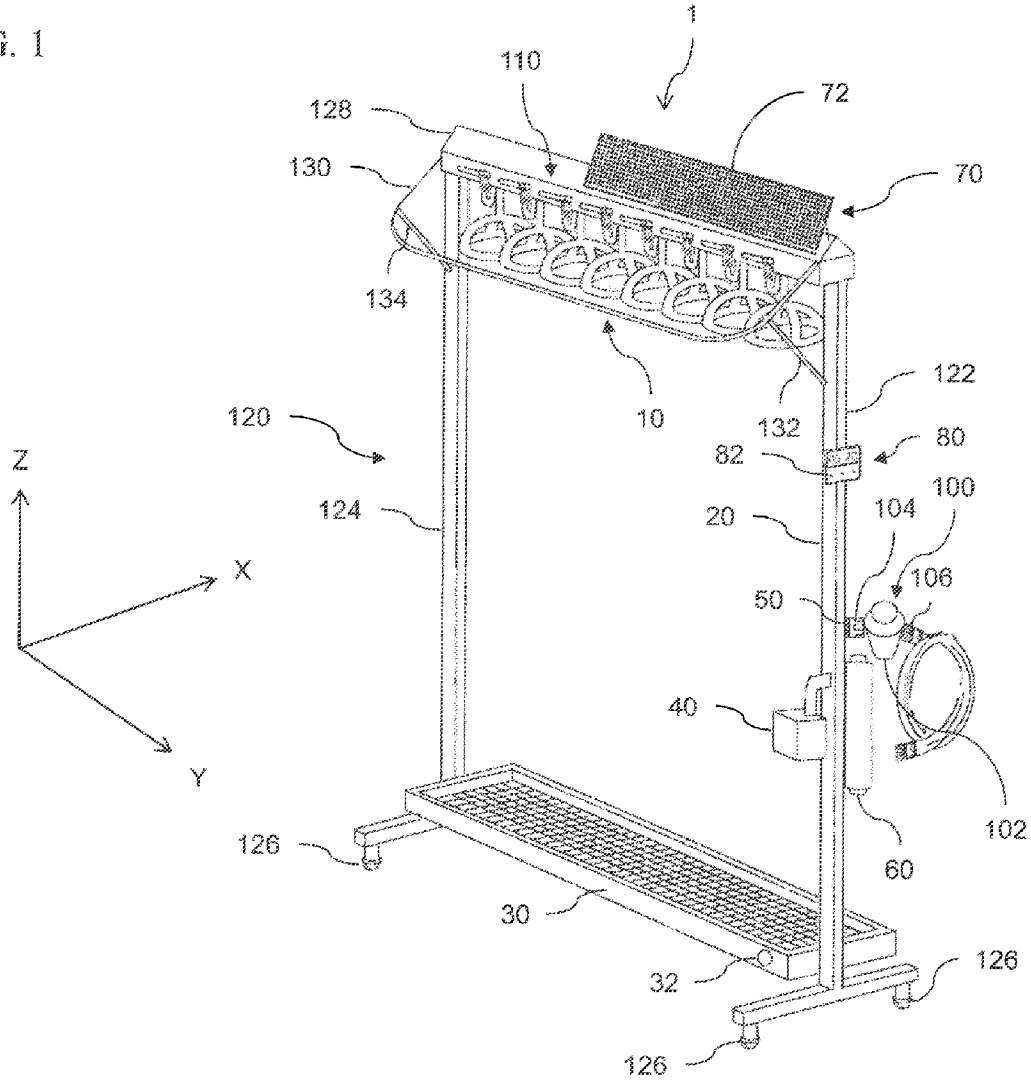
FIG. 1 is a schematic isometric view illustrating a wetsuit washing system according to an embodiment of the present invention.

The present invention is a system and method for providing a wetsuit washing functionality.

The principles and operation of a system and method according to the present invention may be better understood with reference to the drawings and the accompanying description. Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways. Initially, throughout this document, references are made to directions such as, up and down, top and bottom, and the like. These directional references are exemplary only to illustrate the invention and embodiments thereof.

The present invention is applicable to cleaning wetsuits of various size and thickness, and is of particular value when cleaning multiple wetsuits, such as in surfing and diving schools, as well as surf equipment rental shops. Where multiple wetsuits are typically washed simultaneously.

The term wetsuit refers broadly to various wearable ensembles which provide thermal insulated protection to users while immersed in water and should not be limited to a specific technology. For the purposes of this document, the term wetsuit can include ensembles such as, for example, drysuits, which provide thermal insulation to a user without allowing water to accumulate between itself and the user.

Referring now to the drawings, FIG. 1 is an overall schematic diagram of a system 1 and corresponding components for providing a wetsuit washing functionality. With reference to FIG. 1, major elements of system 1 preferably include a hanger assembly 10 for supporting and retaining a wetsuit in an upright hanging position, a piping arrangement 20 in fluid flow communication with hanger assembly 10, and an intake port 50 in fluid flow communication with piping arrangement 20. Hanger assembly 10, piping arrangement 20 and intake port 50 are preferably mounted to a support structure 120, such as a chassis or the like. In FIG. 1, the Cartesian coordinate system XYZ is considered where the XY plane is substantially horizontal to the surface on which system 1 is deployed, namely the ground.

It is noted that in a preferred but non-limiting implementation, system 1 includes a plurality of hanger assemblies 10 in fluid flow communication with piping arrangement 20. While the structure and operation of system 1 described herein is made with reference to a single hanger assembly 10, it should be clear that the structure and operation can be extended to examples in which system 1 includes a plurality of hanger assemblies 10. As such, support structure 120 is preferably made from a material that is capable of supporting weights on the order of magnitude of the maximum number of wetsuits mountable to hanger assemblies 10. Types of materials used for constructing support structure 120 include, but are not limited to, steel, aluminum, and other suitable materials capable of supporting the necessary weight and maintaining structural integrity in the presence of water use. Support structure 120 preferably includes structure support legs 122 and 124 for supporting a canopy 128, with hanger assemblies 10 being mounted to canopy 128. Piping arrangement 20 may be mounted to support leg 122 and canopy 128. In one particular implementation, support leg 122 is hollow, allowing for a section of piping arrangement 20 to be placed inside of the hollow support leg.

Figure 2:
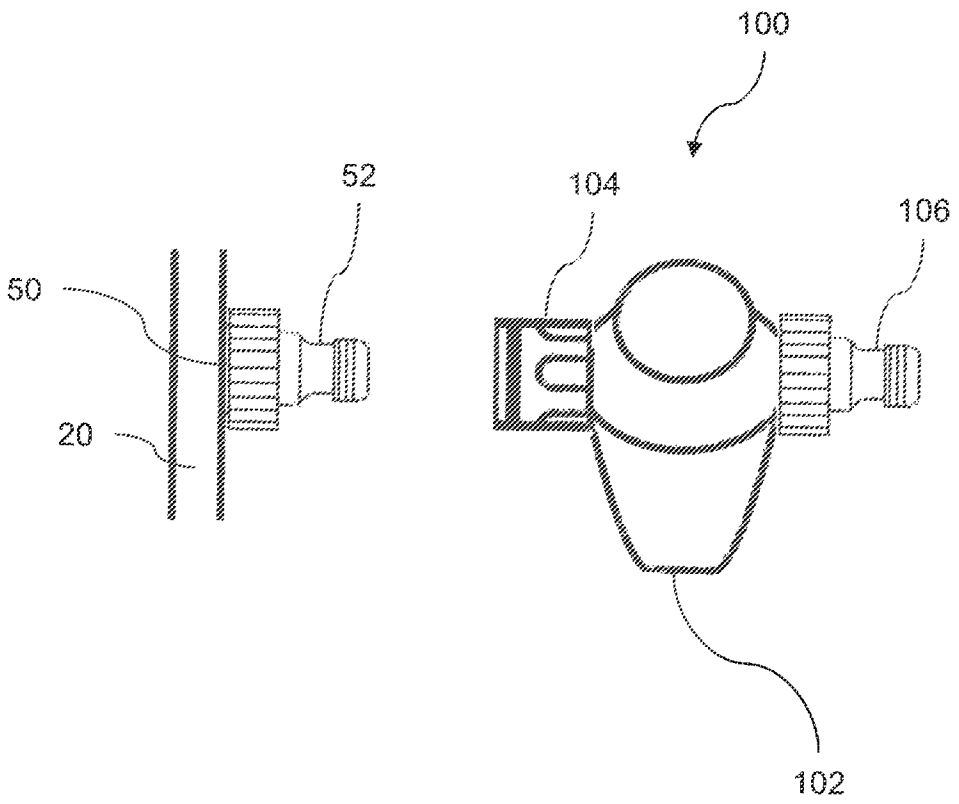
FIG. 2 is a schematic exploded view illustrating an intake port and a detergent mixing unit according to an embodiment of the invention.

Intake port 50 is configured for communicating with a liquid source for supplying a liquid to piping arrangement 20. It is preferred that the liquid source is a source of fresh water, such as a faucet or a tap. Preferably a conduit, such as a common garden hose or the like, is interfaced at a first end to intake port 50, and at a second end to the liquid source. Without loss of generality, the conduit is hereinafter referred to as a hose. Reference to the conduit as a hose should not be considered limiting and is used in this description for naming convention purposes only. Preferably intake port 50 includes an adapter or the like for interfacing with the first end of the hose to allow the intake of liquid. Referring to FIG. 2, a non-limiting implementation is shown in which adapter 52 is a male adapter configured for interfacing with a correspondingly configured female adapter attached to first end of the hose. The liquid, namely fresh water, flows from intake port 50 to hanger assembly 10 through piping arrangement 20. The water cleans the interior and exterior of the wetsuit hanging from hanger assembly 10 as will subsequently be described. Upon completion of cleaning the wetsuit, the wetsuit is preferably left mounted to hanger assembly 10 until the wetsuit is dry.

System 1 preferably includes a valve assembly 110 in communication with a hanger assembly 10 for selectively controlling the flow of liquid to hanger assembly 10. Valve assembly preferably includes a valve 112 and a conduit 114 in fluid flow communication with hanger assembly 10 and piping arrangement 20. Valve 112 is preferably operable between a first state where valve 112 is "open", in which liquid is permitted to flow into hanger assembly 10 from piping arrangement 20 through conduit 114, and a second state where valve 112 is "closed", in which liquid is prevented from flowing into hanger assembly 10. In one non-limiting implementation, the operation of valve 112 is controlled manually by a user. In the preferred but non-limiting implementation of a plurality of hanger assemblies 10, each individual hanger assembly 10 is associated with its own valve assembly 110 for selectively controlling the flow of liquid to that hanger assembly 10. As such, the operation of a valve 112 associated with a particular hanger assembly 10 effects only the flow to the particular hanger assembly 10, and the flow to the remaining hanger assemblies is not affected by that operation.

Referring to FIGS. 3A-3B and 4-5, hanger assembly 10 preferably includes a first irrigation member 11 for supplying the liquid to the interior of the wetsuit, a second irrigation member 12 for supplying the liquid to the exterior of the wetsuit, and an irrigation interface member 14. First irrigation member 11 and interface member 14 are preferably hollow to permit the flow of liquid there through. Interface member 14 preferably interconnects first and second irrigation members 11 and 12 at oppositely disposed ends. In addition to interconnecting first and second irrigations members 11 and 12, interface member 14 provides fluid flow communication between the irrigation members. Interface member 14 is in fluid flow communication with conduit 114 for receiving the inflow of liquid from piping arrangement 20, preferably via an inlet 21 or the like. In the preferred but non-limiting implementation shown in FIG. 3B, inlet includes threading, and conduit 114 includes correspondingly configured threading allowing for valve assembly 110 to be placed in communication hanger assembly 10 by screwing onto inlet 21.

Figure 3A:
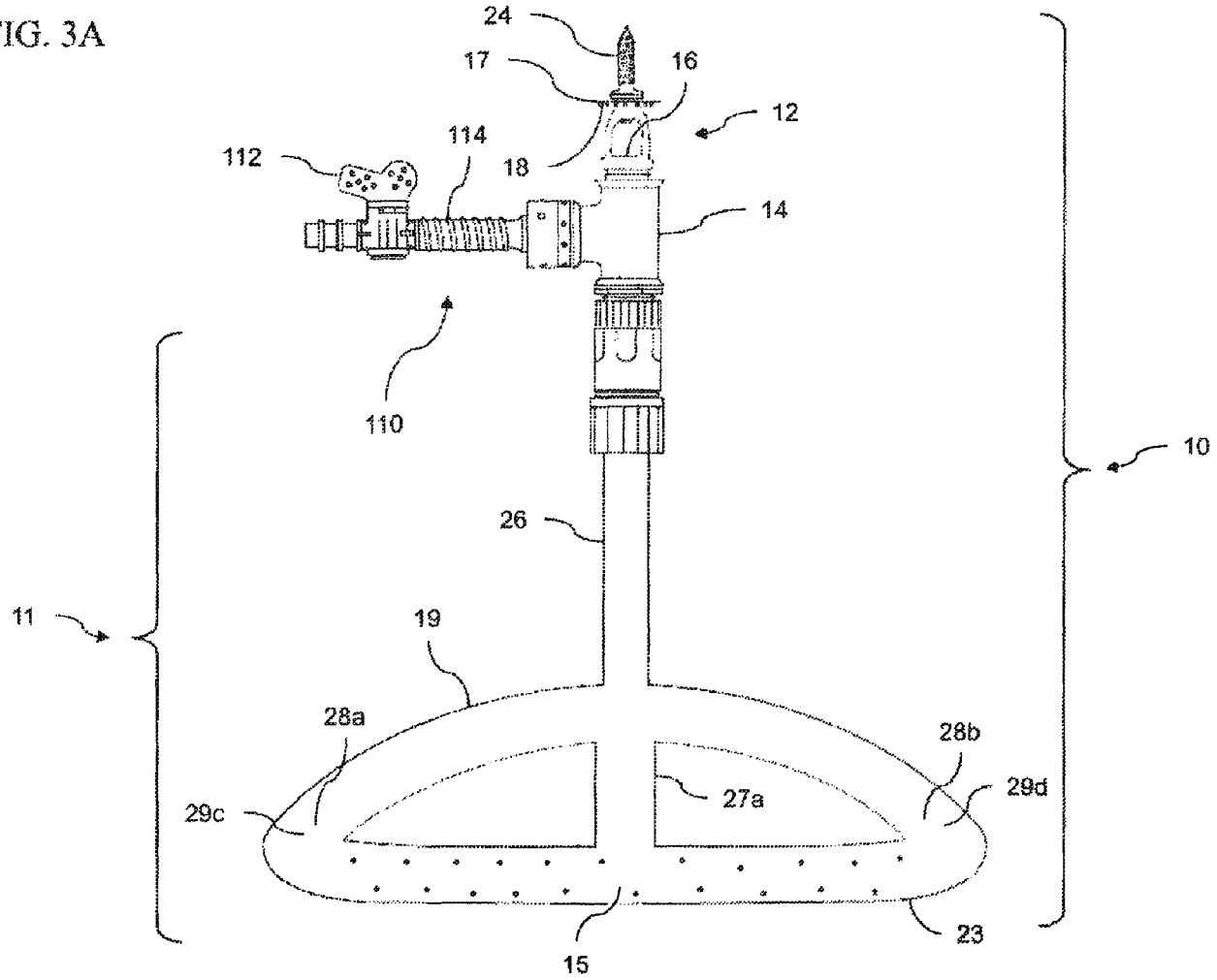
FIG. 3A is a schematic side view illustrating a hanger assembly according to an embodiment of the present invention.
Figure 3B:
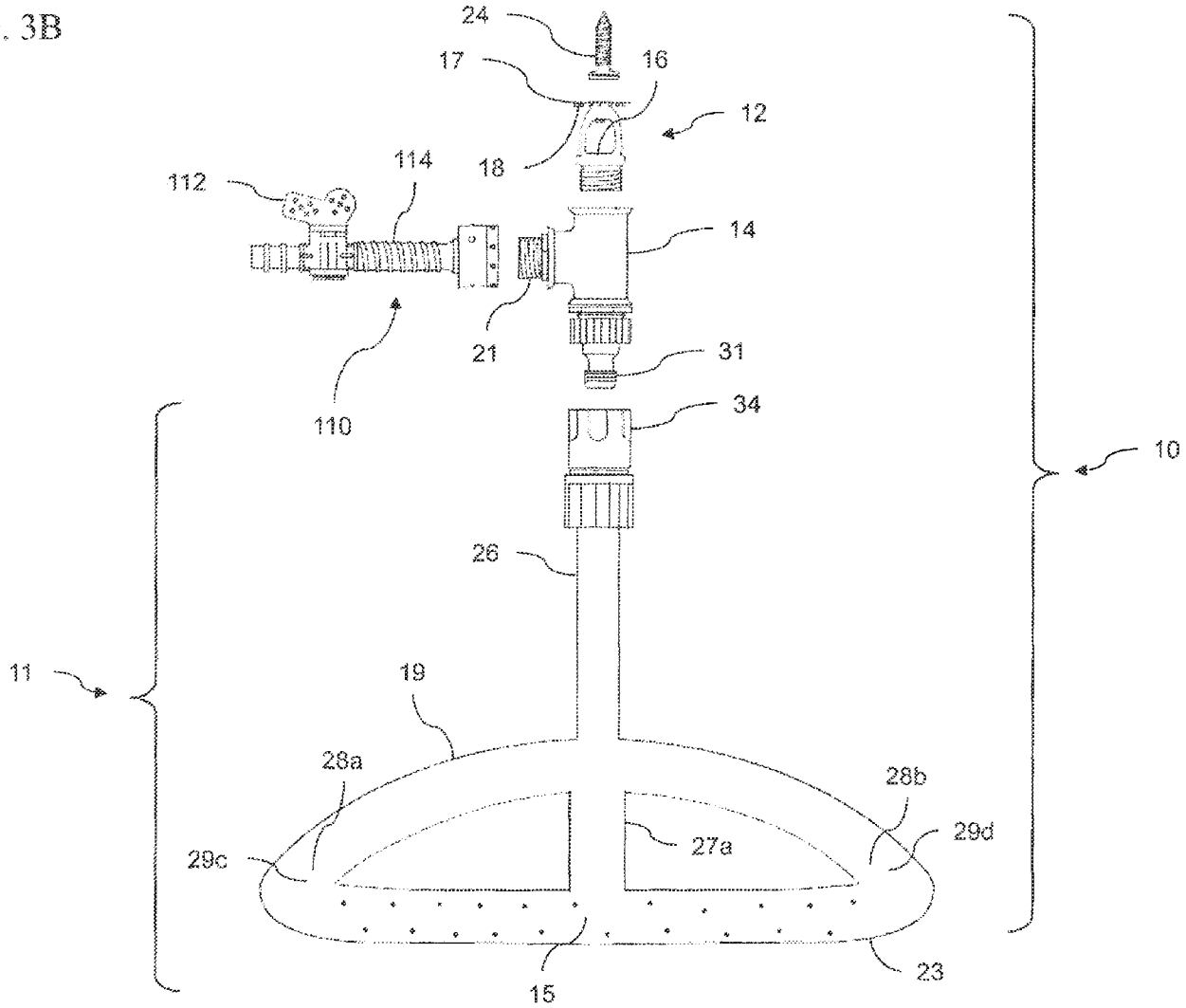
FIG. 3B is a schematic exploded side view illustrating a hanger assembly according to an embodiment of the present invention.

Irrigation interface member 14 may be constructed from aluminum, steel, polyvinyl chloride (PVC), plastic, or any suitable material capable of supporting the weight of first irrigation member 11 and a wetsuit. Preferably hanger assembly 10 is attached to support structure 120 via an attachment mechanism disposed on second irrigation member 12. Types of attachment mechanisms include, but are not limited to, hardware fasteners, welding, ball and socket joints, irrigation connectors/adapters, hooks, clips, and other suitable techniques which provide structural support to the hanger assembly when mounted with a wetsuit. In a preferred but non-limiting implementation as shown in FIGS. 3A-3B, second irrigation member 12 includes a threaded component 24. As such, support structure 120 preferably includes correspondingly configured threading at the designed attachment point allowing for second irrigation member 12 to be placed in communication with support structure 120 by screwing on to support structure 120.

First irrigation member 11 includes a hollow support member 13 for supporting the wetsuit and supplying liquid to the interior of the wetsuit. Preferably, first irrigation member 11 further includes a distributing assembly 22, including an intake pipe 26 and at least one distribution pipe 27, to facilitate the distribution of liquid from interface member 14 to support member 13. In a preferred but non-limiting implementation, distributing assembly 22 includes first and second distribution pipes 27*a* and 27*h*. As shown in FIGS. 3A-3B, interface member 14 is placed in communication with distributing assembly 22, thereby providing the communication between interface member 14 and first irrigation member 11 as previously mentioned. Distributing assembly 22 and interface member 14 may be placed in communication with each other via any suitable means, including, but not limited to, irrigation connectors/adapters, hardware fasteners, industrial adhesive, and the like. In particularly preferred but non-limiting implementation, interface member 14 includes a male irrigation adapter 31 and distributing assembly 22 includes a female irrigation adapter 34. Male irrigation adapter 31 preferably includes threading (not shown) for facilitating the placement of adapter 31 in communication with interface member 14. This implementation facilitates the placement of first irrigation member 11 in communication with interface member 14, and the detachment of first irrigation member 11 from interface member 14, while maintaining the communication between second irrigation member 12 and support structure 120 as previously described it is preferred that in such an implementation, interface member 14 includes a structure to prevent liquid from discharging from interface member 14 when first irrigation member 11 is detached. The structure may be any suitable structure, including, but not limited to, check valves, plugs and the like configured to block the flow of liquid when first irrigation member 11 is detached from interface member 14, and allow the flow of liquid when first irrigation member 11 is placed in communication with interface member 14. First irrigation member 11 may be constructed from any suitable material capable of supporting the weight of a wetsuit. Most preferably, first irrigation member 11 is constructed from polyvinyl chloride (PVC) or plastic and the like.

Figure 4:
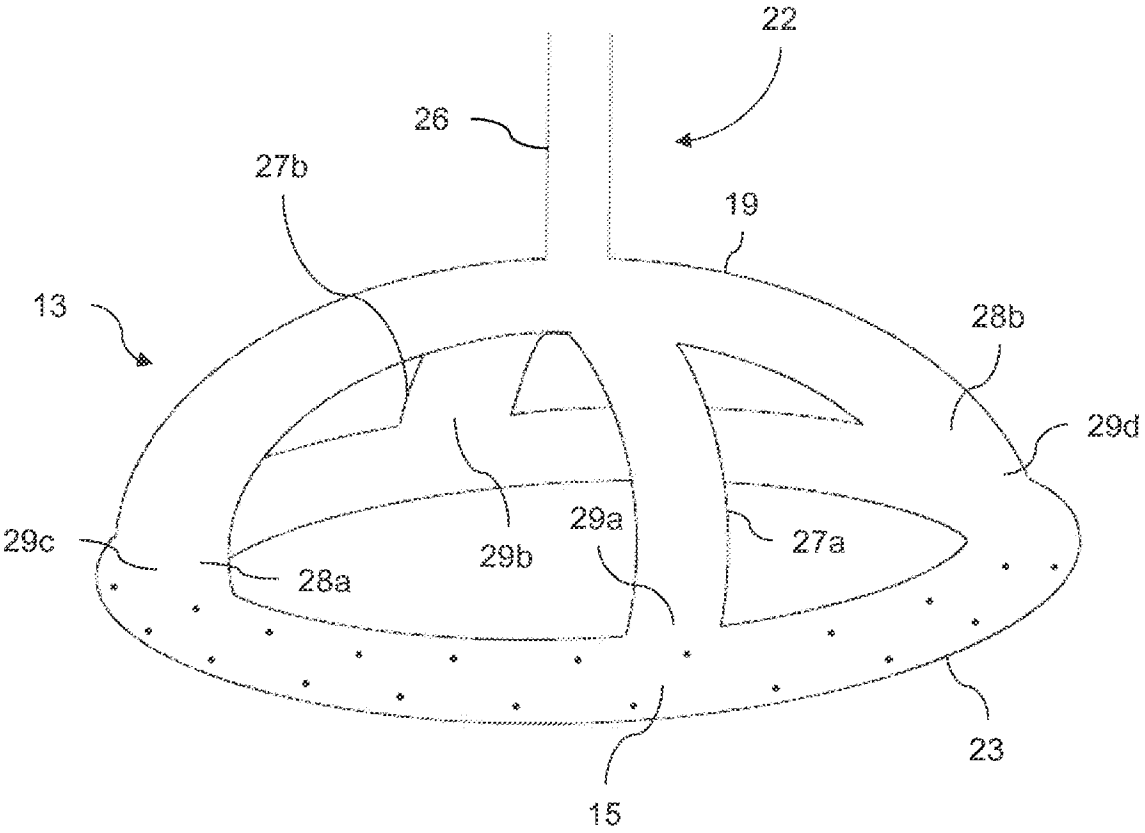
FIG. 4 is a schematic isometric view illustrating an irrigation member according to an embodiment of the present invention.
Figure 5:
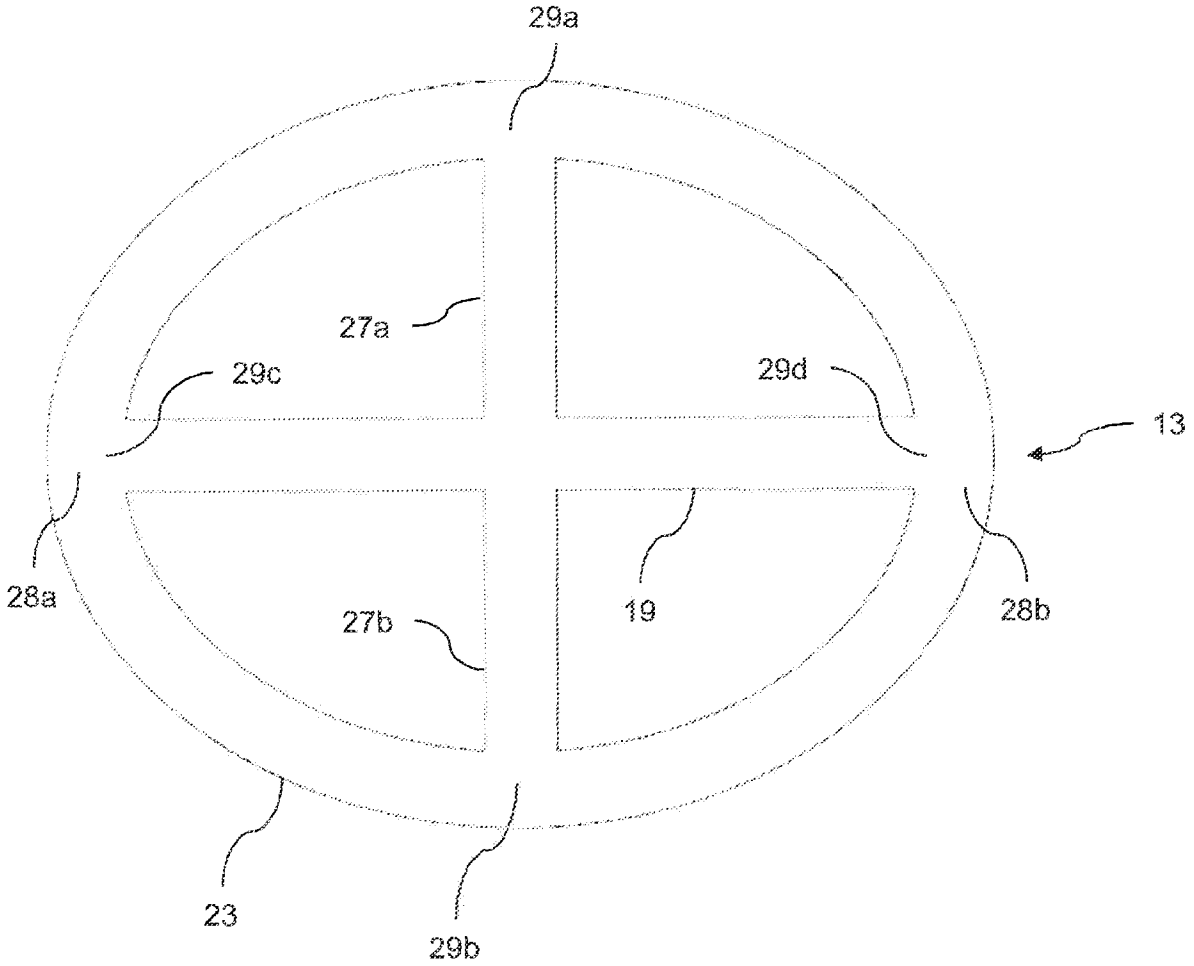
FIG. 5 is a schematic bottom view illustrating an irrigation member according to an embodiment of the present invention.

Support member 13 is preferably of shape which is conducive to retain and support the wetsuit in an upright and hanging position. As shown in FIGS. 3A-3B and 4, support member 13 preferably includes first and second hollow support elements 19 and 23. According to certain preferred embodiments, first support element 19 is substantially arcuate in a first dimension. The arcuate shape accommodates the general neck and shoulder regions of the wetsuit by echoing the curvature of the shoulder. This aids in preventing unnecessary stretching of the wetsuit while the wetsuit is mounted to hanger assembly 10, thereby preventing the wetsuit from becoming poorly fit to the user. Preferably, first support element 19 includes first and second ends 28*a* and 28*b* for placing first support element 19 in communication with second support element 23. As previously mentioned, in a preferred but non-limiting implementation, system 1 includes a plurality of hanger assemblies 10. In such an implementation, it is preferable that the mounted wetsuits do not contact each other, as this may interfere with the cleaning process of individual wetsuits, and may also prolong the drying of the wetsuits. Therefore, in a preferred but non-limiting implementation, the first dimension is substantially in the XZ plane. It is noted that hanger assemblies 10 may be rotated about the Z-axis to achieve the same or similar results, providing that the spacing of hanger assemblies 10 is sufficient to prevent wetsuits from contacting each other. Therefore, it should be understood that the first dimension may be in any plane between the XZ and the YZ plane as rotated about the Z-axis, providing such sufficient spacing.

The neck and shoulder regions of the wetsuit are further accommodated by second support element 23. According to certain preferred embodiments, second support element 23 is substantially elliptical in a second dimension. It is preferred that the second dimension is substantially in the XY plane. The elliptical shape is conducive to support the shoulder region dimensions of the wetsuit by echoing the width of the wetsuit as measured from the chest side of the wetsuit to the back side of the wetsuit. The combination of the arcuate and elliptical shape of support member 13 thus maintains the integrity of the shape of the wetsuit without over stretching and damaging the wetsuit, thereby maintaining the fitting and thermal protection of the wetsuit. It is preferred that second support element 23 includes a plurality of intake ports 29 for placing the distribution pipes in communication with the first support element. In a preferred but non-limiting implementation, second support element 23 includes first, second, third and fourth intake ports 29*a-d*. In such an implementation, first distribution pipe 27*a* is placed in communication with first intake port 29*a*, second distribution pipe 27*b* is placed in communication with second intake port 29*b*, first end 28*a* of first support element 19 is placed in communication with third intake port 29*c*, and second end 28*b* of first support element 19 is placed in communication with fourth intake port 29*d*, it is noted that first and second ends 28*a* and 28*b* can be swapped with each other to achieve the same result. In a similar fashion, first and second distribution pipes 27*a* and 27*b* can be swapped. It is noted that first support element 19, second support element 23, and distributing assembly 22, or any combination thereof, may be forged from a single body.

Figure 6:
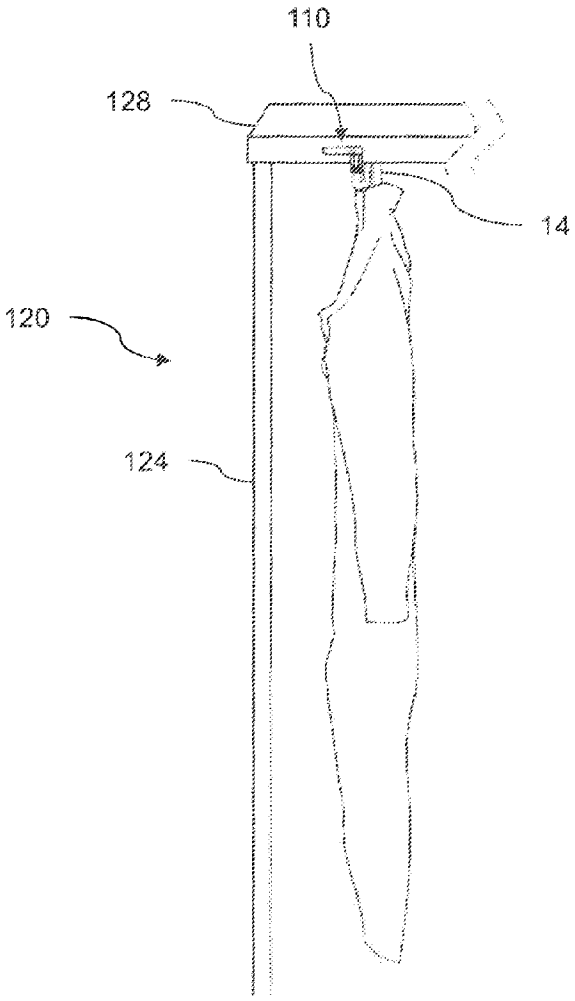
FIG. 6 is a schematic side view illustrating a wetsuit mounted to a hanger assembly according to an embodiment of the present invention.

A wetsuit is typically mounted to hanger assembly 10 by unzipping the wetsuit and positioning the wetsuit on support member 13 such that first support element 19 supports the shoulder regions of the wetsuit, with intake pipe 26 protruding through the neck opening. The wetsuit is then zipped up and left to hang on hanger assembly 10 as depicted in FIG. 6. In the preferred implementation of interface member 14 including a male adapter and first irrigation member 11 including a female adapter, first irrigation member 11 may be detached from interface member 14 to allow for easier mounting of the wetsuit to first irrigation member 11. Once the wetsuit is mounted to first irrigation member 11, first irrigation member is placed in communication with interface member 14 as previously described. Although the system as described thus far has pertained to a support member having a first support element which is substantially arcuate in a first dimension and a second support element which is substantially elliptical in a second dimension, other embodiments are possible, in which support member includes only a substantially elliptical support element in a second dimension. In such an embodiment, the capability of support member 13 to prevent unnecessary stretching of the wetsuit may be slightly degraded, yet still sufficient to retain a wetsuit in an upright and hanging position. Furthermore, second support element 23 may be substantially arcuate the first dimension same as that of first support element 19. The additional arcuate shape of second support element 23 provides further support to the wetsuit when mounted to hanger assembly 10, and aides in maintaining the integrity of the wetsuit.

When valve 112 is "open", the liquid flows from piping arrangement 20 to conduit 114 and into interface member 14. The liquid in turn flows down to hollow support member 13 via distributing assembly 22. In a particularly preferred but non-limiting implementation (FIGS. 4-5), distribution pipes 27*a* and 27*b* are placed in communication with first support element 19. The distribution of liquid to support member 13 is facilitated by placing intake pipe 26 in communication with first support element 19 and distribution pipes 27*a* and 27*b*. In such an implementation, the liquid is distributed to second support element 23 via both of the distribution pipes and the first support element. This allows for liquid to rapidly fill second support element 23. It is noted that in an alternative implementation, only distribution pipes 27*a* and 27*h* may be placed in communication with intake pipe 26, with first support element 19 passing below and between distribution pipes 27*a* and 27*b*. In such an alternative implementation, the liquid from interface member 14 flows down to distribution pipes 27*a* and 27*b*, which subsequently distribute the liquid to second support element 23. In yet another alternative implementation, distribution pipes 27*a* and 27*b* may be removed, and intake pipe 26 may be placed in communication with first support element 19 at a corresponding intake port on the first support element. In such an implementation, the liquid from interface member 14 flows down to first support element 19, which subsequently distributes the liquid to second support element 23. Such alternative implementations may yield a less rapid filling of second support element 23, but nevertheless provide the necessary fluid flow for facilitating the washing of the interior and exterior of a wetsuit.

Second hollow support element 23 includes a plurality of apertures 15, preferably disposed about the perimeter of support element 23 for allowing the liquid to escape from the inside of support element 23 into the wetsuit. Typically, the liquid escapes from apertures 15 when the liquid fluid level occupies a majority of the internal volume of second support element 23. The elliptical shape of second support element 23 allows the liquid to pass through the body, sleeves, and legs of the wetsuit, thereby cleaning the interior of the wetsuit from foreign objects and materials. It is noted that the flow of liquid into first irrigation member 11 acts to slightly pressurize the liquid. Typically, the pressure of the liquid in first irrigation member 11 is in the range of 1-3 bar. When second support member 23 reaches a fluid level sufficient to expel liquid from apertures 15, the pressure differential between first irrigation member 11 and second irrigation member 12 causes the liquid from interface member 14 to simultaneously flow down to hollow support member 13, and up to second irrigation member 12, thereby distributing the liquid to the exterior of the wetsuit. The pressure differential between conduit 114 and interface member 14 acts to prevent liquid from flowing back into piping arrangement 20 from hanger assembly 10. Nevertheless, conduit 114 preferably includes a structure, such as a check valve or the like, which prevents the backflow of liquid from interface member 14 to piping arrangement 20.

In a preferred but non-limiting implementation, as shown in FIG. 3A, second irrigation member 12 is implemented as a sprinkler assembly. Sprinkler assembly 12 preferably includes an irrigation outlet 16 and a sprinkler head 17. In such an implementation, outlet 16 is in fluid flow communication with interface member 14. Sprinkler assembly 12 is preferably placed in communication with interface member 14 by a suitable attachment mechanism, such as, for example, hardware fasteners. In the preferred but non-limiting implementation shown in FIG. 3B, sprinkler assembly 12 includes threading 25, and interface member 14 includes correspondingly configured threading allowing for sprinkler assembly 12 to be screwed on to interface member 14. Alternatively, sprinkler assembly 12 and interface member 14 may be forged from a single body. As previously mentioned, hanger assembly 10 is mounted to support structure 120. As shown in FIGS. 3A-3B, a hardware fastener is disposed on sprinkler head 17 which includes a threaded component 24. The hardware fastener may be placed in communication with sprinkler head 17 by any suitable technique, including, but not limited to, welding and industrial adhesive techniques and the like.

When the liquid flows from hollow interface member 14 into sprinkler assembly 12, the liquid flows out of irrigation outlet 16 and impinges upon the bottom 18 of sprinkler head 17. This causes the liquid to spray out onto the exterior of the wetsuit, thereby cleaning the exterior of the wetsuit. The design of the sprinkler head facilitates a more even distribution of the liquid on the exterior surface of the wetsuit. Although the description thus far has pertained to a hanger assembly with first and second irrigation members, the second irrigation member implemented as a sprinkler assembly, other embodiments are possible, in which second irrigation member is implemented as a hollow pipe or tube with a closed end and a plurality of apertures or slits in proximity to the closed end. In such an embodiment, when the liquid flows from hollow interface member 14 to second irrigation member 12, the liquid is forced out of the apertures or slits proximal to the closed end, resulting in the distribution of the liquid to the exterior of the wetsuit. The liquid which cleans the interior and the exterior of the wetsuit is subsequently allowed to drain from the wetsuit under gravitational flow. For naming convention purposes, the liquid drained from the wetsuit is referred to hereinafter as run-off liquid.

In order to thoroughly clean the wetsuit to remove foreign objects, a large quantity of fresh water is typically used to cycle through hanger assembly 10. Although the wetsuit hanging from hanger assembly 10 can be cleaned exclusively using fresh water from intake port 50, this process can be wasteful in the amount of fresh water consumed. It is therefore preferable to re-use the run-off liquid from the wetsuit by collecting the run-off liquid in a reservoir and recirculating the collected run-off liquid back to piping arrangement 20.

According to certain preferred embodiments, system 1 further includes a reservoir 30 in fluid flow communication with piping arrangement 20 for collecting the run-off liquid, and a pump 40 in fluid flow communication with reservoir 30 for pumping the run-off liquid from reservoir 30 to hanger assembly 10. As shown in FIG. 1, reservoir 30 is preferably positioned at the bottom of system 1 such that it is oriented beneath hanger assembly 10 in order to collect the run-off liquid from the wetsuit. Reservoir 30 preferably includes a structure for preventing debris, such as leaves, trash and other materials from entering reservoir 30 and causing blockages in piping arrangement 40. The structure may be any suitable type of structure. In the non-limiting implementation shown in FIG. 1, the structure is a grate.

Reservoir 20 and pump 30 are preferably placed in communication with support structure 120 by mounting to one of the support legs of support structure 120. Since the run-off liquid may retain a proportion of the foreign objects accumulated in the wetsuit, a filter 60 is preferably positioned in fluid flow communication with reservoir 30 and pump 40. Filter 60 may be any suitable type of filter that is effective in substantially removing particles such as sand, rocks, seashells, and the like. It is noted that filter 60 may not be effective in removing amounts of hazardous materials such as bacteria and fungi or the like, and therefore, the liquid that is output from filter 60 may not be suitable for human consumption. In principle, pump 40 is actuated to pump the run-off liquid from reservoir 30, through filter 60, and into piping arrangement 20. The liquid then flows to hanger assembly 10 through piping arrangement 20 as previously described. The process of recirculating the run-off liquid collected in reservoir 30 is repeated as necessary. It is noted that a continuous supply of fresh water from the fresh water source may be desired in order to reduce strain on pump 40 and filter 60. As such, the fresh water source (faucet or tap) and pump 40 may simultaneously supply liquid to hanger assembly 10. It is preferred that the majority of the liquid supplied to hanger assembly 10 during such simultaneous operation is the filtered run-off liquid. It is noted that pump 40 and filter 60 may be implemented as a single unit.

Although the system as described thus far has pertained to a system including a reservoir in fluid flow communication with a piping arrangement for supplying run-off liquid to a hanger assembly, other embodiments are possible, in which system 1 does not include a built-in reservoir. In such an embodiment, a trough or the like may be positioned beneath hanger assemblies 10 for receiving the run-off liquid from the wetsuits. A conduit may then be placed in communication between the trough and pump 40, allowing for pump 40 to pump the run-off liquid collected in trough to hanger assembly 10 through piping arrangement 20 as previously described.

In the preferred but non-limiting implementation of a plurality of hanger assemblies 10, system 1 preferably includes between 3-20 hanger assemblies 10, and most preferably between 5-15 hanger assemblies 10. The number of hanger assemblies is preferably implemented as a function of the size of support structure 120. Specifically, a longer support structure facilitates the inclusion of a larger number of hanger assemblies. It is noted that a large number of hanger assemblies may result in decreased pressure in first irrigation members 11. It is therefore noted that the pressure levels of the liquid in first irrigation members 11 can be adjusted by modifying the diameter of the piping arrangement. This also allows for pump 40 to operate at relatively low power levels. In the preferred but non-limiting implementation of a plurality of hanger assemblies 10, pump 40 is preferably configured to operate with a power supply of no more than 25 volts direct current (DC). Preferably, system 1 further includes a power supply 70 for powering pump 40. As shown in FIG. 1, power supply 70 is preferably mounted to support structure 120. As system 1 is often used in waterfront areas, such as beaches, rivers, lakes and the like, the system is of particular value when using solar panels to supply power to pump 40. It is therefore most preferable that power supply 70 is a solar panel assembly providing a maximum voltage of 24 volts DC, and typically 12 volts DC. Solar panel assembly 70 preferably includes at least one solar panel 72 for converting the sun's energy into electrical current and subsequently into a voltage. The voltage provided by solar panel assembly 70 may be either a DC voltage or an alternating current (AC) voltage. Due to the relatively low power consumption of pump 40, the energy collected the solar panel assembly is typically sufficient to power pump 40 even on overcast and cloudy days. A charging arrangement, such as, for example, power cables and like, is preferably deployed in communication with solar panel assembly 70 and pump 40. The charging arrangement (not shown) may include a voltage converter for converting the electricity supplied by solar panel assembly 70 from AC to DC, when necessary.

Although the system as described thus far has pertained to a pump powered by at least one solar panel for providing a maximum voltage of 24 volts DC, other embodiments are possible in which pump 40 is powered by a charging arrangement in communication with a mains voltage power supply. In such embodiments, types of charging arrangements may include, but are not limited to, electrical contacts, power cables, and other suitable connections. The term mains voltage power supply refers herein to power supplies of at least 100 volts AC or DC. In more specific terms, a mains voltage power supply in the United States typically supplies power in the range of 100-120 volts AC, while a mains voltage power supply in Europe typically supplies power in the range of 220-240 volts AC. In such an embodiment, the charging arrangement includes a voltage converter for converting the electricity supplied by mains voltage power supply from AC to DC.

The low power consumption of pump 40 also allows for the pumping rate and the rate at which the run-off liquid is collected in reservoir 30 to be of roughly the same order of magnitude. This aids in preventing the run-off liquid from flowing into reservoir 30 too slowly, which may cause reservoir 30 to periodically empty, causing potential damage to pump 40. This also aids in preventing the run-off liquid from flowing into reservoir 30 too quickly, which may cause overflow or stagnation of the liquid in reservoir 30. In order to further reduce the chances of the run-off liquid in reservoir 30 from stagnating, reservoir 30 is positioned at an incline, such that the run-off liquid flows in the direction of pump 40 under gravitational flow. In one particularly preferred but non-limiting implementation, a reservoir of 2 meters in length is positioned with an incline generating an end-to-end height differential ranging from 2-20 centimeters. The ratios of the height differential to reservoir length translate to 1%-10% grade incline, or about 0.6-5.7 degrees. This allows for the run-off liquid to flow slowly towards pump 40 without pooling at the end of reservoir 30 closest to pump 40. The incline of reservoir 30 is preferably made adjustable by including a series of spaced clips or rack mounts on each of structure support legs 122 and 124 (not shown).

Figure 7:
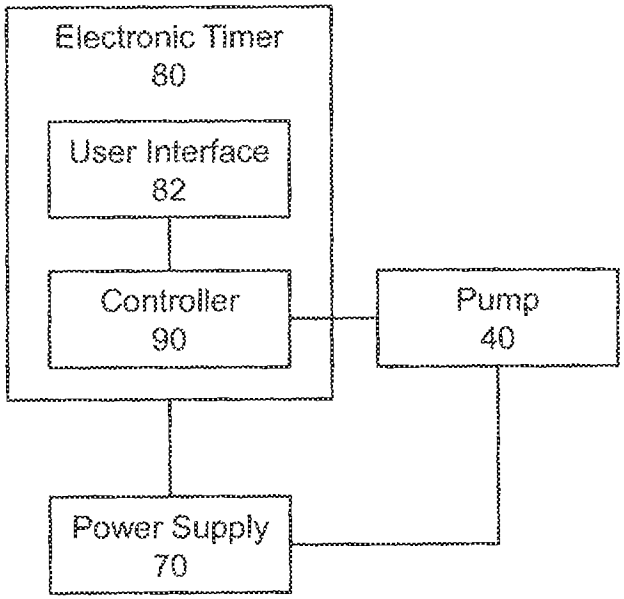
FIG. 7 is a block diagram of a wetsuit washing system timer according to an embodiment of the present invention.

It is preferred that pump 40 is actuated by a user, preferably via a user interface. Referring to FIGS. 1 and 7, according to certain preferred embodiments, system 1 further includes a timing device 80, preferably an electronic timer, associated with a controller 90 for actuating pump 40. Controller 90 may be implemented as a processor providing pump control functionality. In such an embodiment, electronic timer 80 includes a user interface 82 for programming timing device 80. Timer 80 and controller 90 may be battery powered, or may receive power from power supply 70. In preferred but non-limiting implementation, controller 90 is integrated as part of electronic timer 80. As shown in FIG. 1, electronic timer 80 is mounted to support structure 120. In one particularly preferred but non-limiting implementation, electronic timer 80 is programmable to run for a user specified elapsed time period. Alternatively, electronic timer 80 may be configured to run for a pre-set elapsed time period. Preferably, user interface 82 includes functionality for setting a specified elapsed time period, starting a count towards the expiration of the time period, and stopping the count prematurely before the elapsed time period has expired. This functionality is preferably executed by indicators (not shown) such as, for example, "set", "start", and "stop" on user interface 82. In such an implementation, a user may program electronic timer 80, via a "set" command on user interface 82, to a user specified elapsed time period. The user may then control electronic timer 80 to begin a count (either countdown or count up) towards the expiration of the time period by executing a "start" command on user interface 82. When electronic timer 80 begins its count, controller 90 actuates pump 40, causing run-off liquid in reservoir 30 to flow to hanger assembly 10 as previously described. Pump 40 continues to pump the run-off liquid to piping arrangement 20 until the elapsed time period expires, or until the user executes the "stop" command. Preferably, electronic timer 80 emits an alarm sound when the time period expires or when the "stop" command is executed. The alarm sound provides an indication to the user of the cessation of pumping of run-off liquid from reservoir 30 to piping arrangement 20. The remaining run-off liquid collected in reservoir 30 is preferably drained via a drain 32 in reservoir. Drain 32 may be one or more dedicated hole in reservoir 30 with an accompanying removable plug or the like. It is noted that timer 90 may further include functionality to allow the user to manually start and stop pump 40 without having to set, and without the timer having to count, an elapsed timer period.

In operation, a wetsuit is mounted to hanger assembly 10 as previously described. A hose is interfaced with intake port 50 via, adapter 52. The liquid source (faucet or tap) is activated by the user to allow the flow of a first quantity of liquid from intake port 50 to the wetsuit via piping arrangement 20 and hanger assembly 10. The fresh water source is left running until a suitable volume of run-off liquid is collected in reservoir 30. Typically, a single wetsuit uses approximately 1-5 Liters of fresh water for a first quantity. The qualification of a suitable volume may therefore be a function of the number of hanger assemblies 10 configured to receive fresh water from piping arrangement 20 based on the state of valves 112. For example, in a configuration in which system includes eight hanger assemblies 10 with only two hanger assemblies in a valve state to receive liquid, a suitable volume may be in the range of 2-10 Liters. In a configuration in which system 1 includes six hanger assemblies in a valve state to receive liquid, a suitable volume may be in the range of 6-30 Liters. Once the desired volume of run-off liquid is collected in reservoir 30, the user sets electronic timer 80 to a user specified elapsed time period, for example 2 minutes, via user interface 82. As previously described, execution of the "start" command on user interface 82 signals controller 90 to actuate pump 40 to pump the run-off liquid in reservoir to filter 60 and to piping arrangement 20. Thus, subsequent quantities of liquid are supplied to the wetsuit via piping arrangement 20 and hanger assembly 10. As previously mentioned, pump 40 and fresh water source may operate simultaneously, it is therefore noted that the filtered run-off liquid represents at least part of the subsequent quantities of liquid supplied to hanger assembly 10, When the 2 minute elapsed time period expires, pump 40 ceases to pump the run-off liquid to piping arrangement 20, with an audible alarm sounding providing an indication of the completion of the cleaning cycle. In situations in which the fresh water source is continuously supplying fresh water to hanger assembly 10, the fresh water source is closed to stop the inflow of fresh water to intake port 50. The plug is removed from drain 32, and the remaining run-off liquid is drained from reservoir 30. The wetsuits are left to hang on hanger assemblies 10 until dry.

As previously mentioned, the cleaning of wetsuits with fresh water is effective in substantially removing salt water and foreign materials such as sand and the like. However, fresh water may not be effective for removing bacteria, fungi, and other materials which may present health hazards to the user. It is therefore preferable that system 1 further includes a detergent mixing unit 100 for mixing the fresh water with a cleaning substance to create a cleaning solution. The cleaning substance may be a detergent or soap or the like. Various anti-bacterial soaps and detergents are available for cleaning wetsuits, all as is known in the art of wetsuit maintenance.

Referring to FIGS. 1 and 2, detergent mixing unit 100 preferably includes a detergent reservoir 102 for retaining the cleaning substance, a first adapter 104 correspondingly configured to interface with intake port adapter 52, and a second adapter 106 correspondingly configured to interface with the fresh water source via the hose. Second adapter 106 acts as an intake port for receiving liquid from the liquid source. Likewise, first adapter 104 acts as a supply port for interfacing with adapter 52 to supply liquid to piping arrangement 20. Referring to FIG. 1, a non-limiting implementation is shown in which first adapter 104 is a female adapter and second adapter 106 is a male adapter. Such a configuration allows for detergent mixing unit 100 to be placed in fluid flow communication with intake port 50 and the fresh water source via the hose. The water from the hose mixes with the detergent in detergent reservoir 102 via adapter 106 to create a cleaning solution. The cleaning solution subsequently flows to intake port 50 from adapter 104, and subsequently from intake port 50 to hanger assembly 10 through piping arrangement 20 as previously described.

Although the cleaning solution is effective in substantially removing the above mentioned materials, overuse of cleaning solutions may damage the wetsuit. Therefore, it is preferable that detergent mixing unit 100 includes a valve or the like for selectively allowing the liquid from hose to mix with the contents of detergent reservoir 102. The valve allows for the fresh water to bypass detergent mixing unit 100 and flow directly to intake port 50. The fresh water then flows to hanger assembly 10 through piping arrangement 20 as previously described. When using the cleaning solution to clean a wetsuit in conjunction with the recirculation process via filter 60 and pump 40 as previously described, it is preferred to use the cleaning solution in the first cleaning cycle. Therefore, it is preferable that filter 60 is effective in substantially removing traces of the cleaning substance from the runoff liquid collected in reservoir 30.

As previously mentioned, system 1 is of particular value when used outdoors in order to power pump 40, and optionally timer 80 and controller 90, via solar panel assembly 70. However, long term exposure to the sun may damage wetsuits which are mounted to hanger assemblies 10. It is therefore preferred that system 1 further includes a cover 130 for protecting the wetsuits from the sun. Cover 130 is preferably implemented as a retractable awning with first and second collapsible legs 132 and 134. Legs 132 and 134 are preferably configured to attach to support structure support legs 122 and 124, respectively, when cover 130 is deployed. Cover 130 can be made of any suitable material, including, but not limited to, polyester, nylon, acrylic, and other types of synthetic fabrics. It is noted that although cover 130 is shown in FIG. 1 as transparent, this is for illustration purposes only in order to show the major elements of system 1 in a single drawing. The depiction of cover 130 as transparent in FIG. 1 should not limit the color, shape, or structure of cover 130.

The re-use of the run-off liquid in reservoir 30, combined with the preferred cordless power configuration via solar power supply, enables system 1 to be placed in any location in which solar panel assembly 70 receives enough sunlight to power pump 40. The inclusion of wheels facilitates the mobility of system 1, and takes advantage of the location flexibility. As such, it is preferable for support structure 120 to include wheels 126 at the base of the support structure to enable the mobility of system 1. In practice, once the first cleaning cycle of the wetsuit or wetsuits is complete, system 1 may be moved from a first location in proximity to a fresh water source, to a second more isolated location to complete the recirculation cleaning cycles. For example, in the case where system 1 is used to clean wetsuits in a beach front shop, once the first cleaning cycle is complete, system 1 can be moved from the beach front to a patio or courtyard location away from the public.

It should be noted that various aspects of the present invention described herein may each be used independently of other aspects of the invention presented herein. For example, the recirculation of liquid for cleaning wetsuits, although presented in a particularly preferred context of the arcuate and elliptical shaped hanger assembly of the present invention, may also be used to advantage with otherwise conventional shaped hanger assembly constructions, such as, for example, triangular constructions.

It should also be noted that the major elements of system 1 designed to be placed in communication with each other are also designed to be detached from each other in order to facilitate efficient replacement and maintenance of the major elements of system 1. In the implementations described above, several components were described to include adapters, connectors and the like for facilitating such connections and detachment. It is noted that although not explicitly described for all major elements of system 1, it is implied that the major elements of system 1 include adapters, connectors and the like, similar to those described in the preferred but non-limiting implementations, for promoting such connections and detachments. It is also noted that such adapters, connectors, and the like facilitate the efficient assembly of system 1.

It will be appreciated that the above descriptions are intended only to serve as examples, and that many other embodiments are possible within the scope of the present invention as defined in the appended claims.

What is claimed is:

1. A wetsuit washing system comprising:

a support structure including a first support leg and a second support leg, the first support leg including a hollow section;

at least one hanger assembly, a portion of the at least one hanger assembly being removably attachable to the support structure, the at least one hanger assembly for supporting and retaining a wetsuit in an upright hanging position and for supplying a liquid to the wetsuit;

a piping arrangement in fluid flow communication with the at least one hanger assembly, the piping arrangement for distributing the liquid to the at least one hanger assembly, wherein a section of the piping arrangement is deployed within the hollow section of the first support leg;

a reservoir in fluid flow communication with the piping arrangement deployed below the support structure to collect a run-off liquid from the wetsuit, the reservoir having a first end and a second end, the first end being hydraulically coupled to the hollow section of the first support leg at a first height, and the second end being coupled to the second support leg at a second height different from the first height; and a pump in fluid flow communication with the reservoir for pumping the run-off liquid collected in the reservoir through the piping arrangement to the at least one hanger assembly.

2. The system of claim 1, further comprising:

a controller functionally associated with the pump configured to actuate the pump to pump the run-off liquid; and a timing device functionally associated with the controller, the timing device including a user interface, the controller responsive to an input via the user interface to selectively:

actuate the pump to allow the flow of the run-off liquid to the piping arrangement; and prevent the flow of the run-off liquid to the piping arrangement.

3. The system of claim 1, further comprising:

a power supply deployed to provide power to the pump, the power supply including at least one solar panel.

4. The system of claim 1, further comprising:

a filter in fluid flow communication with the pump configured to filter the run-off liquid collected in the reservoir.

5. The system of claim 1, further comprising:

an intake port in fluid flow communication with the piping arrangement, the intake port configured for communicating with a hose for supplying the liquid to the piping arrangement.

6. The system of claim 5, further comprising:

a detergent mixing unit in fluid flow communication with the intake port for supplying a detergent mixture to the piping arrangement.

7. The system of claim 1, wherein the at least one hanger assembly comprises:

a first irrigation member configured to supply the liquid to the interior of the wetsuit, the first irrigation member including first and second support elements, the first support element substantially arcuate in a first plane, and the second support element substantially elliptical in a second plane that is substantially perpendicular to the first plane, the first and second support elements sufficient to support and retain the wetsuit in an upright and hanging position and to maintain the integrity of the shape of the wetsuit.

8. The system of claim 7, wherein the second support element includes a plurality of apertures for allowing the liquid to escape into the interior of the wetsuit.

9. The system of claim 7, wherein the at least one hanger assembly further comprises:

a second irrigation member in fluid flow communication with the first irrigation member configured to supply the liquid to the exterior of the wetsuit.

10. The system of claim 1, further comprising:

a valve assembly in fluid flow communication with the at least one hanger assembly for selectively controlling the flow of liquid to the at least one hanger assembly.

11. The system of claim 1, wherein at least one of the first and second heights is adjustable.

12. The system of claim 1, wherein the second height is greater than the first height.

13. The system of claim 1, wherein the support structure further includes a canopy coupled to, and extending substantially between, the first and second support legs, and wherein the at least one hanger assembly is removably attachable to the canopy.

14. A method for washing a wetsuit comprising:

mounting a wetsuit onto a hanger assembly, the hanger assembly including a hollow irrigation member to permit the flow of liquid there through for supplying to the wetsuit;

mounting the hanger assembly onto a support structure that includes a first support leg and a second support leg, the first support leg including a hollow section;

supplying a first quantity of liquid to the hanger assembly from a liquid source;

deploying a reservoir having first and second ends below the hanger assembly by hydraulically coupling the first end to the hollow section of the first support leg at a first height, and operatively coupling the second end to the second support leg at a second height different from the first height;

collecting a run-off liquid from the first quantity of liquid in the reservoir and allowing the collected run-off liquid to flow under gravitational flow towards the first end; and pumping the collected run-off liquid from the first end through a piping arrangement, deployed at least in part in the hollow section of the first support leg, to the hanger assembly, the pumped liquid forming at least part of a second quantity of liquid supplied to the hanger assembly.

15. The system of claim 1, wherein the pump is deployed proximate to the second end of the reservoir.

16. The system of claim 1, wherein the reservoir extends along substantially the entirety of the length of the support structure.

17. The method of claim 14, wherein the supplying the first quantity of liquid is performed in a first geographical location, and wherein the pumping the collected run-off liquid is performed in a second geographical location different from the first geographical location.

* * * * *